US008522368B2

(12) United States Patent
McIntosh et al.

(10) Patent No.: US 8,522,368 B2
(45) Date of Patent: Sep. 3, 2013

(54) PROTECTIVE GARMENT WITH VAPOR SKIRT

(75) Inventors: Josephine McIntosh, Beattyville, KY (US); Martin Lee Taylor, Sr., Rogers, KY (US); Thomas S. Martin, Huber Heights, OH (US)

(73) Assignee: Lion Apparel, Inc., Dayton, OH (US)

( * ) Notice: Subject to any disclaimer, the term of this patent is extended or adjusted under 35 U.S.C. 154(b) by 559 days.

(21) Appl. No.: 12/421,665

(22) Filed: Apr. 10, 2009

(65) Prior Publication Data

US 2009/0255031 A1 Oct. 15, 2009

Related U.S. Application Data

(60) Provisional application No. 61/043,946, filed on Apr. 10, 2008.

(51) Int. Cl.

| | |
|---|---|
| ***A62B 17/00*** | (2006.01) |
| ***A62D 5/00*** | (2006.01) |
| ***A41D 1/00*** | (2006.01) |
| ***A41D 3/02*** | (2006.01) |

(52) U.S. Cl.
USPC ..... 2/458; 2/81; 2/93

(58) Field of Classification Search
USPC ..... 2/458, 81, 84, 85, 87, 93, 96, 97, 2/108
See application file for complete search history.

(56) References Cited

U.S. PATENT DOCUMENTS

| | | | | |
|---|---|---|---|---|
| 1,214,893 | A * | 2/1917 | Butler | 2/85 |
| 1,763,892 | A * | 6/1930 | Knoernschild | 2/93 |
| 1,773,456 | A * | 8/1930 | Good | 2/85 |
| 2,180,497 | A * | 11/1939 | Barkin | 2/97 |
| 2,391,352 | A * | 12/1945 | Schwartz | 2/93 |
| 5,157,790 | A | 10/1992 | Aldridge | |
| 5,933,873 | A * | 8/1999 | Curran et al. | 2/247 |
| 6,684,408 | B2 | 2/2004 | Rindle et al. | |
| 6,687,913 | B2 | 2/2004 | Aldridge | |
| 7,404,214 | B2 * | 7/2008 | Woolcott et al. | 2/85 |
| 2005/0022285 | A1 * | 2/2005 | Berns et al. | 2/69 |
| 2005/0114979 | A1 | 6/2005 | Woolcott et al. | |
| 2007/0169247 | A1 * | 7/2007 | Mordecai et al. | 2/81 |
| 2009/0320191 | A1 * | 12/2009 | Grilliot et al. | 2/458 |

FOREIGN PATENT DOCUMENTS

| | | |
|---|---|---|
| DE | 20319694 | 3/2004 |
| EP | 1685766 | 8/2006 |

OTHER PUBLICATIONS

"Previewing CB•Ready™," by Globe CB.Ready™, (5 pages) (2006).
"Project Heroes," by Total Fire Group (4 pages) (2005).
"Chempak™ Products. Enhanced Functionality in Chemical and Biological Environments," by W.L. Gore & Associates, Inc. (2007).
PCT, International Search Report and Written Opinion, International Application No. PCT/US2009/040135; 14 pages (Mar. 1, 2010).
PCT, International Preliminary Report on Patentability, International Application No. PCT/US2009/040135; (Oct. 21, 2010).

* cited by examiner

*Primary Examiner* — Amber Anderson
(74) *Attorney, Agent, or Firm* — Thompson Hine L.L.P.

(57) ABSTRACT

A coat including a torso portion defining a torso cavity and including pair of portions that are releasably connectable together. The coat further includes a skirt positioned in the torso cavity. The coat is configured such that when the coat is worn by a wearer and the portions are releasably connected together the skirt generally sealingly engages the wearer. The coat is further configured such that the skirt automatically generally sealingly engages the wearer when the coat is worn by the wearer and the portions are releasably connected without requiring any further action by the wearer.

29 Claims, 5 Drawing Sheets

PROTECTIVE GARMENT WITH VAPOR SKIRT

This application claims priority to U.S. Provisional Application Ser. No. 61/043,946, filed on Apr. 10, 2008, the entire contents of which are hereby incorporated by reference.

The present invention application relates to protective garments, and more particularly, to protective garments configured to increase protection from harmful materials, such as noxious vapors.

BACKGROUND

Protective or hazardous duty garments are used in a variety of industries and settings to protect the wearer from hazardous conditions such as heat, fire, smoke, cold, sharp objects, chemicals, liquids, fumes and the like. Such protective or hazardous duty garments are often used in adverse conditions, such as in the presence of high temperatures, smoke, chemicals, vapors and the like. However, existing garments may not provide sufficient protection from harmful vapors.

SUMMARY

In one embodiment, the present invention is a garment having a skirt to protect the wearer from harmful vapors and/or other undesired materials. In particular, in one embodiment the invention is a coat including a torso portion defining a torso cavity and including pair of portions that are releasably connectable together. The coat further includes a skirt positioned in the torso cavity. The coat is configured such that when the coat is worn by a wearer and the portions are releasably connected together the skirt generally sealingly engages the wearer. The coat is further configured such that the skirt automatically generally sealingly engages the wearer when the coat is worn by the wearer and the portions are releasably connected without requiring any further action by the wearer.

DETAILED DESCRIPTION

Figure 1:
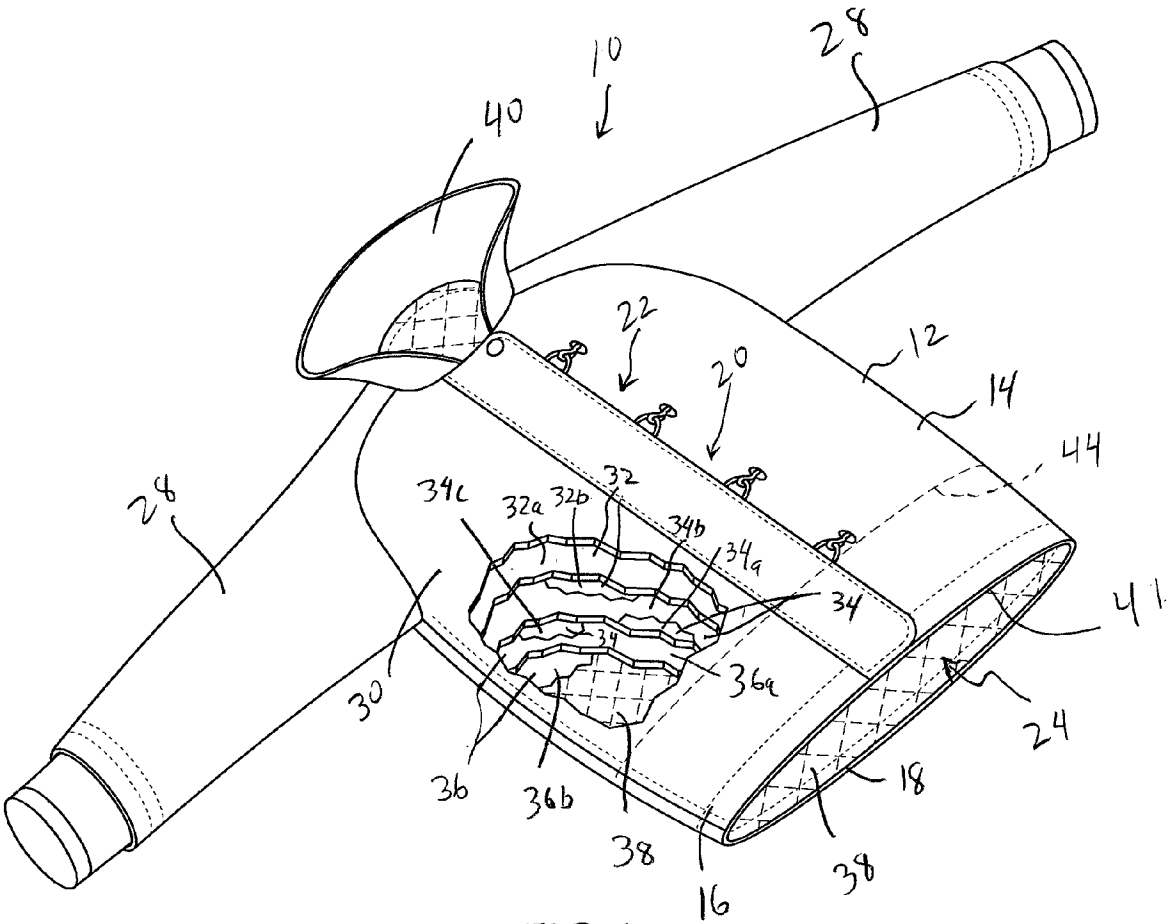
FIG. 1 is a front perspective view of one embodiment of the coat of the present invention, with certain layers cut away for illustrative purposes.

FIG. 1 illustrates a protective or hazardous duty garment in the form of a firefighter's coat, generally designated 10. The coat 10 may include a body portion 12 having a left front panel or portion 14, right front panel or portion 16, and a back panel or portion 18. The panels/portions 14, 16, 18 may be made of separate pieces of material that are joined together, or can be made of a single piece of material, or various pieces of material joined in varying manners, etc. The left front panel 14 and right front panel 16 may each have an inner edge 20 that are releasably attachable together by a fastener 22, such as a zipper, snaps, clasps, clips, hook-and-loop fastening material (i.e., VELCRO® fastening material), combinations of these components or the like. The body portion 12 defines a torso portion/torso cavity 24 that is shaped to receive a wearer's torso 26 therein (see FIGS. 2 and 3). The coat 10 may include a pair of sleeves 28 coupled to and extending generally outwardly from the body portion 12 that are shaped to receive a wearer's arms therein.

The coat 10 may include various layers through its thickness to provide various heat, moisture and abrasion resistant qualities to the coat 10 so that the coat 10 can be used as a protective, hazardous duty, and/or firefighter garment. For example, the coat 10 may include an outer shell 30, a thermal liner or barrier 32 located inside of and adjacent to the outer shell 30, and a moisture barrier/vapor barrier 34 located inside of and adjacent to the thermal barrier 32. A second thermal liner 36 may be located inside of and adjacent to the moisture barrier 34, and an inner liner or inner face cloth 38 may be located inside of and adjacent to the second thermal liner 36.

The outer shell 30 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of PBI Performance Fabrics of Charlotte, N.C.). Thus, the outer shell 30 may be an aramid material, a blend of aramid materials, a polybenzamidazole material, a blend of aramid and polybenzamidazole materials, or other appropriate materials. If desired, the outer shell 30 may be coated with a polymer, such as a durable, water repellent finish (i.e. a perfluorohydrocarbon finish, such as TEFLON® finish sold by E. I. Du Pont de Nemours and Company of Wilmington, Del.). The materials of the outer shell 30 may have a weight of, for example, between about five and about ten oz/yd$^2$.

The moisture barrier 34 and thermal liners 32, 36 may be generally coextensive with the outer shell 30, or spaced slightly inwardly from the outer edges of the outer shell 30 (i.e., spaced slightly inwardly from the outer ends of the sleeves 28, the collar 40 (or the upper edge of the collar 40) and from the lower edge 41 of the coat 10) to provide moisture and thermal protection throughout the coat 10. The thermal liner 32 may be made of nearly any suitable material that provides sufficient thermal insulation. In one embodiment, the thermal liner 32 may include a relatively thick (i.e. between about 1/16"-3/16") batting, felt or needled non-woven bulk or batting material 32*a*. The bulk material 32*a* can also take the form of one or two (or more) layers of E-89® spunlace fabric made of a combination of NOMEX® and KEVLAR® fabric. The bulk material 32*a* can also, or instead, include aramid fiber batting (such as NOMEX® batting), aramid needlepunch material, an aramid non-woven material, an aramid blend needlepunch material, an aramid blend batting material, an aramid blend non-woven material, foam (either open cell or closed cell), or other suitably thermally insulating materials. The bulk material 32*a* may trap air and possess sufficient loft to provide thermal resistance to the coat 10.

The bulk material 32*a* may be quilted to a thermal liner face cloth 32*b* which can be a weave of a lightweight aramid material. Thus, either the bulk material 32*a* alone, or the bulk material 32*a* in combination with the thermal liner face cloth 32*b*, may be considered to constitute the thermal liner 32. In the illustrated embodiment, the bulk material 32*a* is located between the outer shell 30 and the thermal liner face cloth 32*b*. However, the orientation of the thermal liner 32 may be reversed such that the thermal liner face cloth 32*b* is located between the outer shell 30 and the bulk material 32*a*. If desired, the thermal liner 32, or parts thereof, may be treated with a water-resistant or water-repellent finish.

The second thermal liner 36 may have the same qualities and properties as the thermal liner 32 described above. For example, the second thermal liner 36 may have a bulk material 36*a* and a liner 36*b*. However, the liner 36*b* may be omitted, and, for example, inner liner 38 may form the liner for the bulk material 36*a* of the second thermal liner 36. Moreover, the second thermal liner 36 may be completely omitted if desired, or omitted in only certain parts of the coat 10, as will be described in greater detail below. In locations where the second thermal liner 36 is omitted, the thermal protective qualities of the thermal liner 32 may be increased to account for the omission of the second thermal liner 36, as described in greater detail below.

In one embodiment, the thermal liner 32 (or the combined qualities of the liners 32, 36) may have a thermal protection performance ("TPP") of at least about twenty, and in another embodiment, at least about thirty five. Moreover, in one embodiment the coat 10 as a whole has a TPP of at least about twenty, and in another embodiment has a TPP of at least about thirty-five.

The moisture barrier 34 may include a semi-permeable membrane layer 34*a* and substrates 34*b*, 34*c* positioned on either side thereof. The membrane layer 34*a* may be generally water vapor permeable but generally impermeable to liquid moisture. The membrane layer 34*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, GORE® CHEMPAK® materials, sold by W.L. Gore & Associates, Inc. including GORE® CHEMPAK® Ultra Barrier Fabric, GORE® CHEMPAK® Selectively Permeable Fabric, or GORE® CHEMPAK® Sorptive Fabric, or other materials.

The membrane layer 34*a* may have microscopic openings that permit moisture vapor (such as water vapor) to pass therethrough, but block liquids (such as liquid water) from passing therethrough. The membrane layer 34*a* may be made of a microporous material that is either hydrophilic, hydrophobic, or somewhere in between. The membrane layer 34*a* may also be monolithic and may allow moisture vapor transmission therethrough by molecular diffusion. The membrane layer 34*a* may also be a combination of microporous and monolithic materials (known as a bicomponent moisture barrier), in which the microporous or monolithic materials are layered or intertwined.

The membrane layer 34*a* may be bonded or adhered to substrates 34*b*, 34*c* of a flame and heat resistant material on either side thereof to provide structure and protection to the membrane layer 34*a*. Each substrate 34*b*, 34*c* may be or include aramid fibers similar to the aramid fibers of the outer shell 30, but may be thinner and lighter in weight. Each substrate 34*b*, 34*c* may be woven, non-woven, spunlace or other materials. If desired, and in certain embodiments, the moisture barrier 34 may include only a single substrate on one side thereof.

In FIG. 1 the thermal liner 32 is shown as being positioned between the outer shell 30 and the moisture barrier 34. However, if desired, and for use in certain applications, the positions of the moisture barrier 34 and thermal liner 32 may be reversed such that the moisture barrier 34 is located between the outer shell 30 and the thermal liner 32. In addition, the second thermal liner 36 can be positioned at various locations throughout the thickness of the coat 10.

The inner face cloth 38 may be the innermost layer of the coat 10, located inside the thermal liners 32, 36/moisture barrier 34. The inner face cloth 38 can provide a comfortable surface for the wearer and protect the thermal liners 32, 36 and/or moisture barrier 34 from abrasion and wear. The inner face cloth 38 may be quilted to the adjacent layer (i.e. the second thermal liner 36 in the embodiment of FIG. 1). The coat 10 may include various arrangements of liners/materials, as desired, in which the various layers described herein are included, omitted, and/or rearranged. For example, the coat 10 may lack any thermal liner 32, 36, and include only an outer shell 30, moisture/vapor barrier 34 and inner face cloth 38, or may include only an outer shell 30 and a moisture/vapor barrier 34, or may include only a moisture/vapor barrier 34, or may take on various other configurations as desired.

Each layer of the coat 10, and the coat 10 as a whole, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat and flame resistance and for tear strength. For example, in order to meet the NFPA standards, the outer shell 30, moisture barrier 34, thermal liners 32, 36 and inner face cloth 38 must be able to resist igniting, burning, melting, dripping, separation and/or shrinking by more than 10% in any direction at a temperature of 500° F. for at least five minutes. Furthermore, in order to meet the NFPA standards, the combined layers of the coat 10 must provide a thermal protective performance rating of at least thirty-five.

Figure 2:
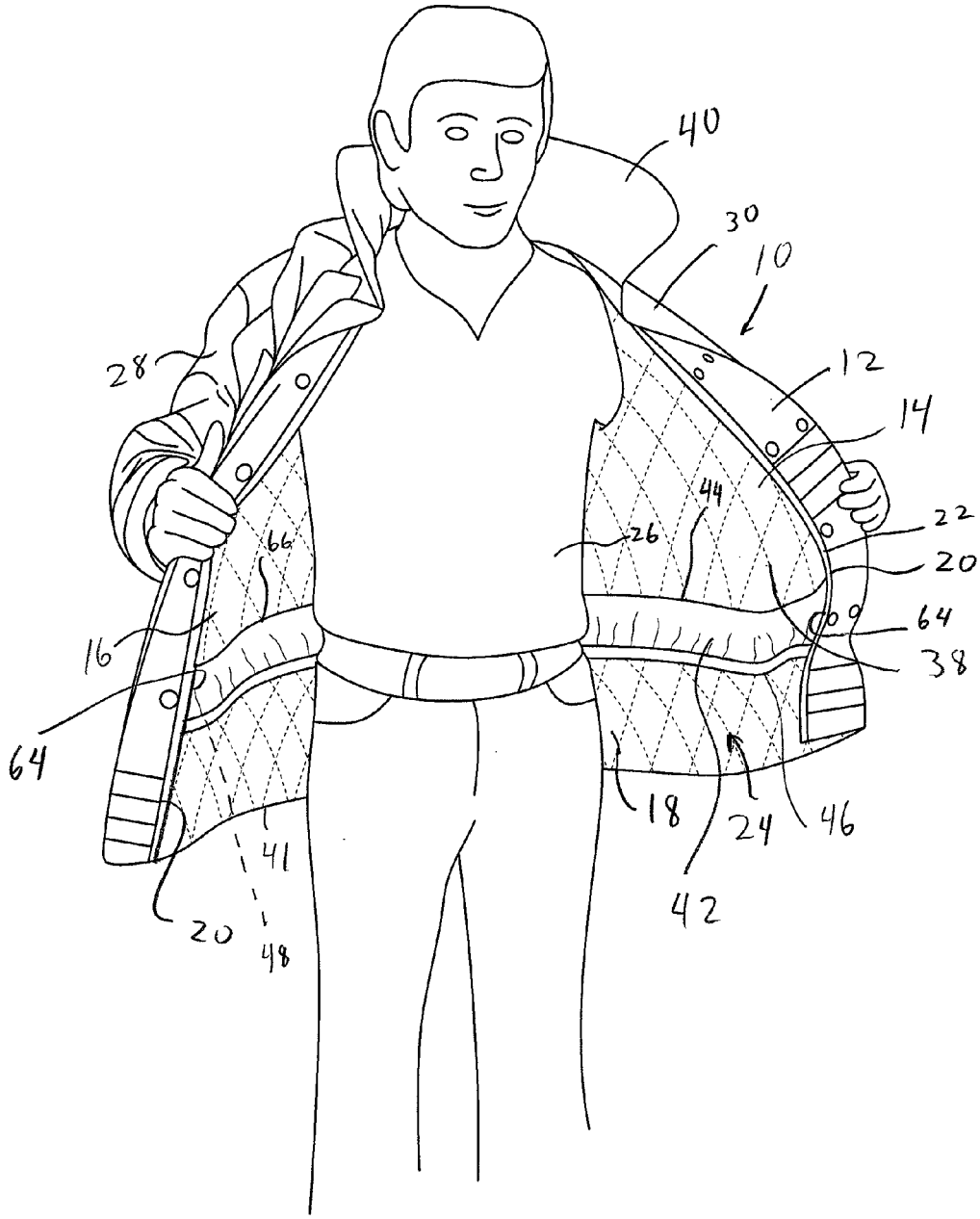
FIG. 2 is a front view of the coat of FIG. 1 being worn and opened to expose the vapor skirt.
Figure 3:
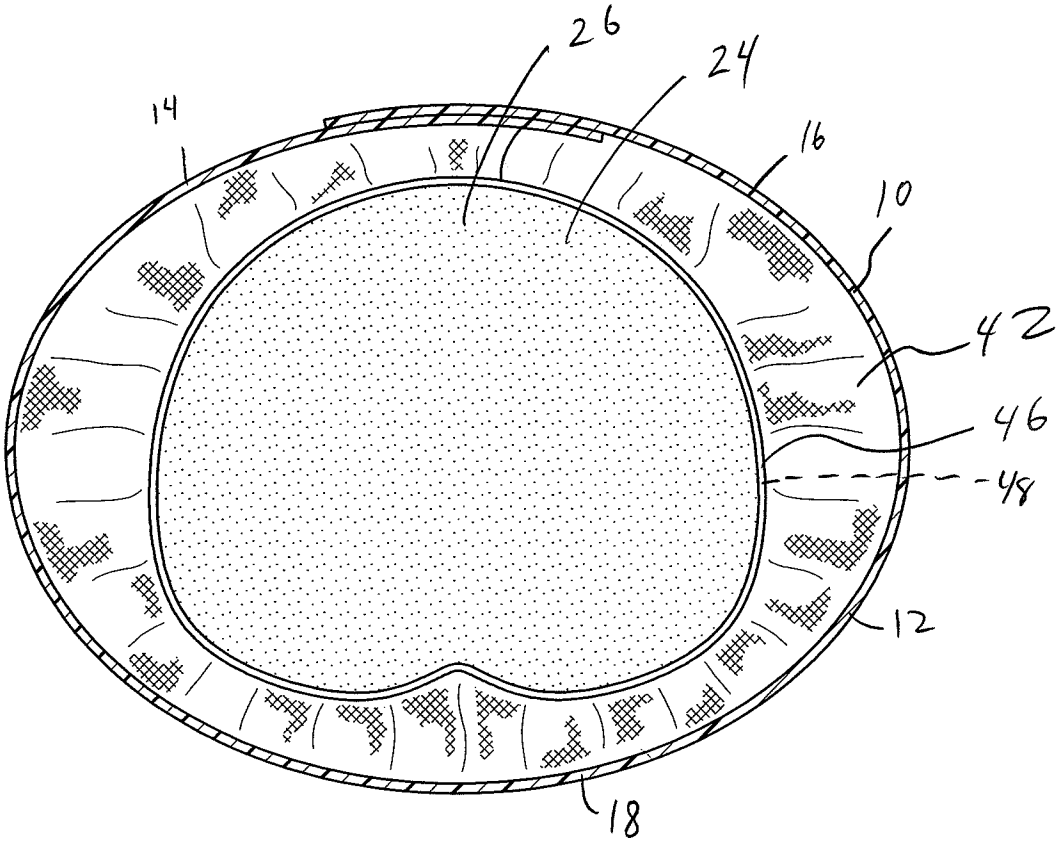
FIG. 3 is a sectional view taken through the torso of the coat and wearer of FIG. 2.

With reference to FIG. 2, the coat 10 may include a vapor skirt 42. The vapor skirt 42 can take the form of a generally flat, rectangular piece of material (when laid flat) coupled to an inner surface of the coat 10. The vapor skirt 42 may be coupled to the inner surface of the coat 10 along the entire or substantially the entire inner perimeter of the coat 10/torso portion 24 at a vertical height position 44 (also see FIG. 1). The skirt 42/coat 10 are configured such that when the coat 10 is closed, the vapor skirt 42 may extend about 360 degrees about the wearer 26, as shown in FIG. 3.

The vapor skirt 42 may have an elastic material 48 coupled to or forming an inner edge 46 thereof to ensure that the vapor skirt 42 contacts and generally forms a seal with the wearer 26 (i.e. the wearer's clothes) and generally blocks ambient and superheated vapors from extending upwardly past the vapor skirt 42.

In particular, in the illustrated embodiment the vapor skirt 42 includes a strip of elastic material 48 positioned on or adjacent to its inner edge 46. As shown in FIG. 3, when the coat 10 is closed, the elastic material 48 is stretched such that the inner edge 46 of the vapor skirt 42 fits around, and conforms to, the torso/body of the wearer 26. Thus in this configuration when the coat 10 is closed the vapor skirt 42 is generally "disc" shaped with a central opening that corresponds to the torso of the wearer 26.

As shown in FIG. 2, when the coat 10 is opened (i.e. the left front panel 14 is not attached to the right front panel 16 and the panels 14, 16 are moved apart, and/or when the coat 10 is not being worn), the elastic material 48 retracts to its unstressed or undeformed shape, thereby gathering the material of the skirt 42. The elastic material 48 may stretch between about 15%-75% (about 50%, in one case) when the coat 10 moves from its open position to its closed position, and return to its original state when the stretching forces are removed. It may be desired to configure the elastic material 48 so that when the coat 10 is closed and the vapor skirt 42 is deployed, the vapor skirt 42 is stretched smooth and flat, with little or no bunching at or adjacent to the elastic material 48 so that the vapor skirt 42 forms a good and relatively tight seal with the wearer. If there is too much elastic material 48 (or the elastic material 48 is too strongly elastic) then the vapor skirt 42 will not be pulled tight and will remained bunched up at or adjacent to the elastic material 48 when the vapor skirt 42 is employed. Conversely if there is not enough elastic material 48 (or the elastic material 48 is too weakly elastic) the vapor skirt 42 may not be about to be stretched about a wearer. Accordingly, the amount and strength of the elastic material 48 may be selected to ensure a proper seal is formed with wearers of a variety of sizes and shapes.

Figure 4:
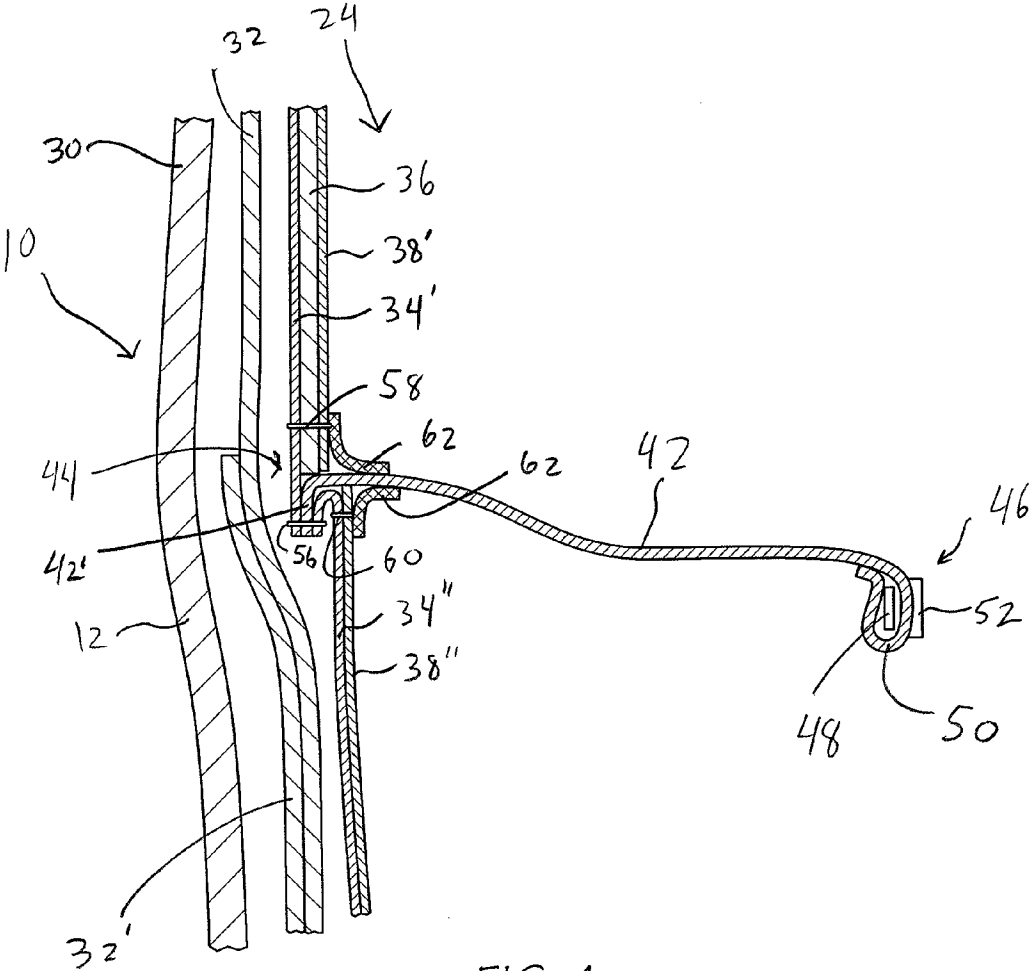
FIG. 4 is a side cross sectional view of part of the coat of FIG. 2, illustrating one manner in which the vapor skirt may be attached to the coat.

In the embodiment of FIG. 4, the material of the vapor skirt 42 forms or is formed into a closed loop 50 at its inner edge 46, and the elastic material 48 is positioned in, or captured in, the loop 50. This configuration protects the elastic material 48, and allows the material of the skirt 42 (and the loop 50) to slide freely relative to the elastic material 48 as the elastic material 48 is stretched and retracts. In this embodiment, a gripping material 52 (such as rubber, synthetic rubber, or the like) may coupled to the radially inner edge 46 of loop 50. The gripping material 52 helps to ensure that the inner edge 46 of the loop 50 frictionally engages the wearer's torso 26 (or clothing) to ensure a relative tight seal therewith, as shown in FIG. 3.

Figure 5:
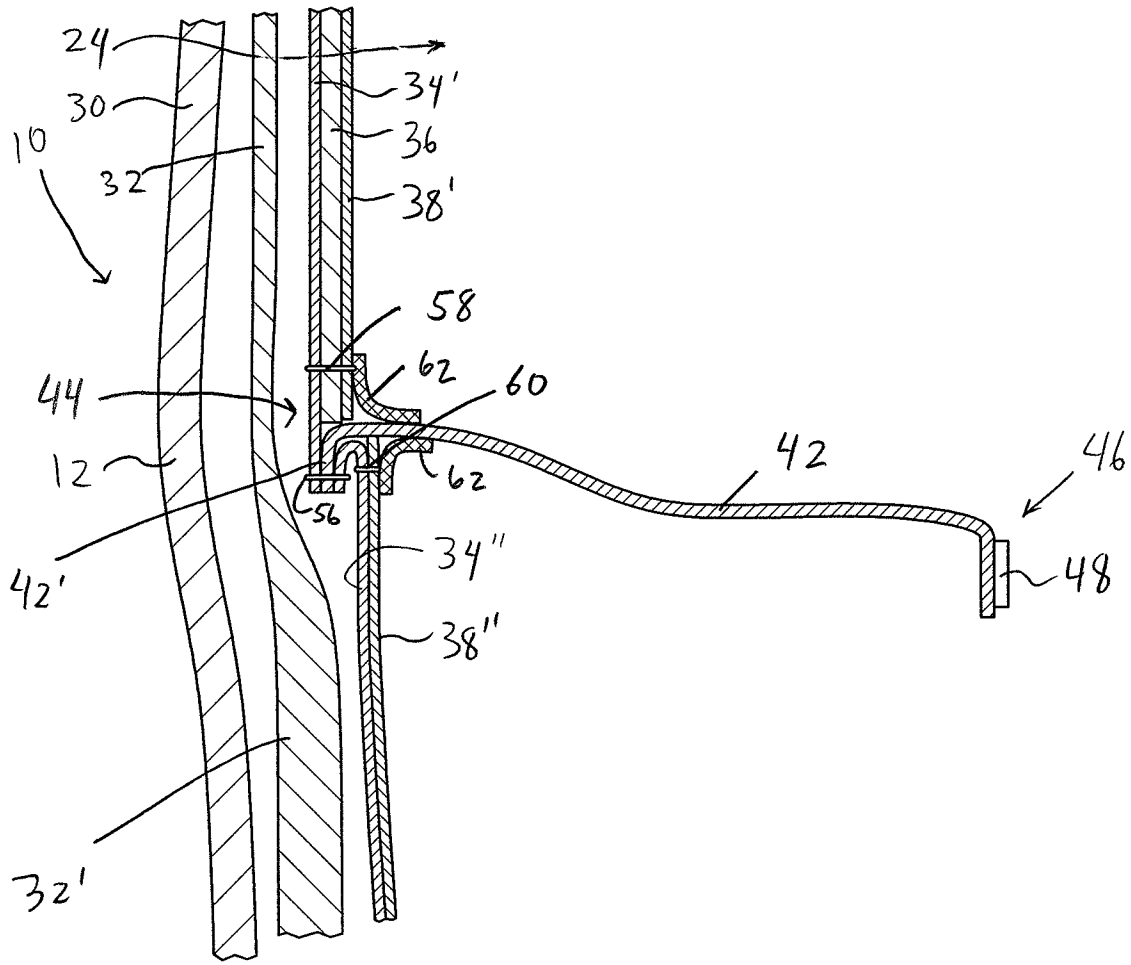
FIG. 5 is a side cross sectional view of part of the coat of FIG. 2, illustrating a differing thermal liner system than that used in FIG. 4.

FIG. 5 illustrates an alternate embodiment wherein the vapor skirt 42 lacks the closed loop 50. In this embodiment the elastic material 48 is directly attached to the inner edge 46 of the skirt 42, such as by stitching, adhesives or the like. In this embodiment the elastic material 48 may act as a gripping surface which frictionally grips the wearer's torso, and a separate gripping surface may not be needed.

The seal formed by the vapor skirt 42 can help to prevent the introduction of harmful materials into the torso cavity 24 of the coat 10. Such harmful materials may include liquids (including chemical warfare agents, biological warfare agents and toxic industrial chemicals), vapors and aerosols (including chemical warfare agents and toxic industrial chemicals), and contaminated particulates (such as biological warfare agents). Examples of chemical warfare agents include soman (GD) nerve agent and distilled mustard (HD) blister agent. Examples of toxic industrial chemicals include acrolein (liquid), acrylonitrile (liquid), ammonia (gas), choline (gas), and dimethyl sulfate (liquid). However, it should be understood that the vapor skirt 42 can be utilized to prevent or minimize the introduction of nearly any desired material, gas, fluid, liquid, particulate solids, etc. into the torso cavity 24, including smoke, water vapor, liquid water, etc.

The vapor skirt 42 helps to form a seal and prevent, or significantly limit, the introduction of undesired materials into the torso cavity 24 above the vapor skirt 42. NFPA 1971 standards include a Chem/Bio Option (the entire contents of which are hereby incorporated by reference) which provides specifications that protective ensembles must meet in order to be certified under that Option. For example, the Chem/Bio Option specifies that the garment must pass a MIST test (Man-In-Simulant-Test). In one case the MIST test essentially consists of introducing the garment 10 and a wearer (or mannequin) into a chamber filled with a vaporized test material (such as oil of wintergreen). Absorbent padding is placed on the wearer of the garment 10, and/or inside the garment. After the garment 10 has been exposed to the vaporized material for a sufficient period of time, the garment 10 is removed from the chamber. The absorbent pads are removed and analyzed to determine how much of the vaporized test material they have absorbed. The vapor skirt 42, in combination with various other protective features, may provide a garment/ensemble which passes the MIST test, and more broadly, which meets the Chem/Bio Option of NFPA 1971 standards.

The vapor skirt 42 can be made of a variety of materials. For example, the vapor skirt 42 can be made of the same materials of the moisture barrier/vapor barrier 34, which are described above. The advantage of this arrangement is that a separate material for the vapor skirt 42 does not have to be handled by the manufacturer. For example, the skirt 42 and/or moisture barrier 34 may be made of made of or include PTFE (such as GORE-TEX or CROSSTECH materials), polyurethane-based materials, neoprene-based materials, cross-linked polymers, polyamid, or GORE® CHEMPAK® materials, sold by W.L. Gore & Associates, Inc. including GORE® CHEMPAK® Ultra Barrier Fabric, GORE® CHEMPAK® Selectively Permeable Fabric, or GORE® CHEMPAK® Sorptive Fabric. The moisture barrier 34 and/or vapor skirt 42 may also include one or both of the substrates 34*b*, 34*c* described above.

As noted above, the membrane layer 34*a* of the moisture barrier 34 and/or the skirt 42 may be generally water vapor permeable but generally impermeable to liquid moisture. In this case the skirt 42 may allow water vapor to pass through (to allow venting), but block harmful materials due to the differing molecule size of water vapor and the harmful materials. Besides the materials outlined above, the skirt 42 can be made of nearly any material that is generally impermeable to the unwanted materials.

Rather than being made of the same material as the moisture barrier 34, the vapor skirt 42 can instead be made of a different material than that of the moisture barrier 34. In this case the vapor skirt 42 may be made of a generally liquid and/or vapor and/or gas impermeable material, such as neoprene. The advantage of this arrangement is that a cheaper material, or a material that is more effective at blocking the undesired material, can be utilized in the vapor skirt 42. Moreover, if desired, the moisture barrier/vapor barrier 34 can be made of a generally liquid and/or vapor and/or gas impermeable material, such as neoprene.

The vapor skirt 42 may be attached to the moisture barrier 34 so as to form a seal therewith. In particular, as shown in FIG. 4, the moisture barrier 34 of the garment may include an upper moisture barrier portion 34' positioned above the vapor skirt 42 and a lower moisture barrier portion 34" positioned below the vapor skirt 42. Similarly, the inner-most inner face cloth 38 may include an upper face cloth portion 38' and a lower face cloth portion 38". The inner edge of the vapor skirt 42 may extend through the face cloth portions 38', 38" and moisture barrier portions 34, 34'.

In the illustrated embodiment the second thermal liner portion 36 is positioned only in the upper portion of the garment; that is, between the upper face cloth portion 38' and the upper moisture barrier portion 34'. In this case the second thermal liner portion 36 is not provided below the skirt 42. However, in order to accommodate for the lack of the additional thermal liner portion 36 below the vapor skirt 42, a supplemental thermal liner portion 32' is provided below the vapor skirt 42, and coupled to the thermal liner 32. FIG. 4 illustrates the supplemental thermal liner portion 32' as a separate thermal liner attached to the thermal liner 32. However, if desired the supplemental thermal liner 32' may take the form of increased thickness and/or weight which is unitary/integral, and formed as one piece with, the remainder of the thermal liner 32, as shown in FIG. 5. Moreover, if desired, the coat 10 may have the same arrangement of the thermal liner 32 and/or 36 below the vapor skirt 42 as is provided above the vapor skirt 42, or the lower arrangement shown herein may be provided above the vapor skirt 42. In addition, as noted above the coat 10 may include various arrangements of liners/materials, as desired. For example, the coat 10 may lack any thermal liner 32, 32', 36, and include only an outer shell 30 and moisture/vapor barrier 34, etc. The garment 10 need not necessarily be NFPA compliant, and could be a non-NFPA compliant garment.

The vapor skirt 42 may include an extension portion or a vertically flared portion 42' sandwiched between the moisture barrier portions 34', 34" with stitching 56 extending through all three layers 34', 42', 34". The lower moisture barrier portion 34" may have a looped upper end that is attached by the stitching 56. The upper moisture barrier portion 34', second thermal liner 36 and upper face cloth portion 38' may be attached by stitching 58 (positioned just above the vapor skirt 42), and the lower moisture barrier portion 34" and lower face cloth portion 38" may be attached by stitching 60 (positioned just below the vapor skirt 42).

A sealing material 62 may be provided and extend between the upper face cloth portion 38' and the vapor skirt 42, and another piece of sealing material 62 extends between the lower face cloth portion 38" and the vapor skirt 42. In one embodiment, the sealing material 62 is a tape made of the same materials as the membrane 34*a* of the moisture barrier 34 (such as PTFE), or the materials of the vapor skirt 42, with an adhesive applied thereto, although the sealing material 62 can take a variety of other forms, including sealants applied in a liquid form and cured into a solid. This arrangement ensures that a generally continuous moisture barrier/harmful material barrier is maintained within the garment 10 which prevents undesired penetration of moisture/harmful material. In addition, to the extent the stitching 56, 58, 60 compromises the sealed integrity of the garment 10, the tape/sealant 62 helps to minimize the effects of such a compromise.

As shown in FIG. 2, the vapor skirt 42 may be attached to the garment 10 along a pair short, vertical side seams 64 adjacent to the front of the coat 10 (adjacent to the edges 20), and along a longer horizontal seam 66 extending substantially the entire perimeter/width of the coat 10 (at the height location 44). In this manner, the skirt 42 may be permanently and fixedly coupled to the coat 10, such as by stitching, adhesives, etc. This arrangement ensures that, whenever the coat 10 is closed (i.e. when the left front panel 14 and right front panel 16 are joined) the vapor skirt 42 forms a seal around the wearer 26 and helps to limit the introduction of harmful materials. Thus, this configuration provides a "always-on" feature such that the wearer 26 does not need to remember to secure the vapor skirt 42, or carry out any other operations, to obtain the benefit of the protection of the vapor skirt 42. In addition, the "always on" feature ensures that, should the wearer unexpectedly enter a hazard zone which includes harmful materials, the wearer does not need to open the coat 10 to ensure that the vapor skirt 42 is in a protective position. If the wearer were required to open the coat 10 in a hazard zone, the wearer's exposure to harmful materials is significantly increased while the coat 10 is opened, thereby defeating the very purpose of the protective nature of the garment 10.

Alternately, if desired, the vapor skirt 42 may be releasably/removably coupled to the coat 10. For example, if desired, one or both of the side seams 64 of the vapor skirt 42 may be releasably coupled to the inner surface of the coat 10 by zippers, snaps, clasps, clips, hook-and-loop fastening material, combinations of these components, etc. This arrangements eliminates "pulling," or resistance of the coat 10 to being closed due to the stretching of the elastic material 48 of the vapor skirt 42. Alternately, or in addition, the outer edge 66 of the vapor skirt 42 may be releasably coupled by the same or similar means as the side edges 64. In one embodiment, both the sides 64 and outer edge 66 of the vapor skirt 42 are releasably/removably attached such that the entire vapor skirt 42 is removable from the coat 10 to allow repair, replacement or cleaning thereof.

The outer edge 66/height location 44 of the vapor skirt 42 may be spaced from the bottom edge 41 the coat 10 by between about zero to about eighteen inches. It may be desired to space the vapor skirt 42 from the bottom edge 41 of the coat 10 to allow easy opening/closing of the coat 10 and to protect the vapor skirt 42 from abrasions, punctures, etc. However, if the vapor skirt 42 is positioned too high, its protective benefits are reduced. In particular, it may be desired to ensure that the vapor skirt 42 is not positioned above the upper edge (i.e. the waist edge) of a pair of trousers worn win the coat 10, to ensure that harmful materials are also prevented from entering the trousers.

If desired, the coat 10 may include a "chest gatherer" system to help reduce the volume of air trapped inside the coat 10. For example, U.S. Pat. No. 5,157,790 to Aldridge, the entire contents of which are incorporated herein, discloses a lumbar support in the form elastic bands or strips extending around the waist portion of the garment. The straps can be pulled tight around the wearer's body and attached to each other. A similar arrangement can be utilized in the chest of the coat 10 (i.e. the straps can be positioned under the arms 28 of the coat 10.) In this case, when the chest gatherer is utilized, the volume of air retained within the coat 10 is reduced, and therefore the volume of harmful materials able to enter the torso cavity 24 of the coat 10 is correspondingly reduced. The reduced volume inside the coat 10 works in concert with the vapor skirt 42 to protect the wearer.

The coat 10 may include various other features to protect from harmful materials. For example, a hood, in the form of a one-piece or split hood (not shown), may be utilized to fit around a wearer's head, which can engage with a mask to form a fluid-tight ensemble.

Although the invention is shown and described with respect to certain embodiments, it should be clear that modifications will occur to those skilled in the art upon reading and understanding the specification, and the present invention includes all such modifications.

What is claimed is:

1. A coat comprising:

a torso portion defining a torso cavity and including pair of portions that are releasably connectable together;

a skirt positioned in said torso cavity, wherein said coat is configured such that when said coat is worn by a wearer and said portions are releasably connected together said skirt generally sealingly engages the wearer, wherein the coat is configured such that said skirt automatically generally sealingly engages the wearer when said coat is worn by the wearer and said portions are releasably connected without requiring any further action by the wearer; and a moisture barrier made of a material that is generally liquid impermeable and generally moisture vapor permeable, wherein the moisture barrier has a first portion and a second portion;

wherein the skirt is directly and sealingly coupled to and sandwiched between the material of the first portion of the moisture barrier and the material of the second portion of the moisture barrier.

2. The coat of claim 1 wherein said coat is configured such that when said coat is worn by the wearer and said portions are releasably connected together an inner edge of said skirt generally entirely conforms to the wearer.

3. The coat of claim 2 wherein said coat is configured such that when said coat is worn by the wearer and said portions are not releasably connected together, at least part of said skirt does not generally conform to the wearer.

4. The coat of claim 1 wherein said skirt is configured such that when the coat is worn by the wearer and said portions are releasably connected together said skirt extends continuously between said torso portion and said wearer around substantially an entire perimeter of the wearer to generally block harmful vapors from moving above the skirt.

5. The coat of claim 4 wherein said coat is configured such that when said coat is worn by the wearer when said portions are not releasably connected together, at least part of an inner edge of said skirt does not sealingly engage the wearer.

6. The coat of claim 1 further including a pair of sleeves coupled to and extending generally outwardly from the torso portion.

7. The coat of claim 1 wherein said skirt is coupled to said torso portion along a line extending generally parallel to a bottom of edge of said coat and is positioned adjacent to an outer edge of each of said portions.

8. The coat of claim 1 wherein said skirt is coupled to said torso portion about substantially an entire perimeter of said torso portion when said portions are releasably connected.

9. The coat of claim 1 wherein said skirt is positioned adjacent to a bottom edge of said torso portion.

10. The coat of claim 1 wherein at least part of said skirt is releasably coupled to said torso portion.

11. The coat of claim 1 wherein said skirt includes a strip of elastic material extending along or adjacent to an inner edge thereof which aids in gathering the material of said skirt when the portions are not releasably connected together.

12. The coat of claim 1 wherein said skirt is made of a generally liquid impermeable material.

13. The coat of claim 1 wherein the coat conforms with National Fire Protection Association 1971 Standards for Protective Firefighting Garments, and the Chem/Bio Option thereof.

14. The coat of claim 1 wherein said torso portion is configured to receive the torso of a wearer therein, and wherein said pair of portions are positioned on a front side of said coat.

15. The coat of claim 1 wherein the coat includes an outer shell that resists igniting, burning, melting, dripping or separation when exposed to a temperature of 500° F. for at least five minutes.

16. The coat of claim 15 further comprising a moisture barrier located generally inside said outer shell such that said moisture barrier is positioned between said outer shell and a wearer when said coat is worn, said moisture barrier being made of a material that is generally liquid impermeable and generally moisture vapor permeable.

17. The coat of claim 15 further comprising a thermal liner located generally inside said outer shell such that said thermal liner is positioned between said outer shell and a wearer when said coat is worn, wherein said thermal liner has a thermal protection performance of at least about twenty.

18. A protective garment comprising:

a torso portion defining a torso cavity and including pair of front portions, the torso portion comprising a plurality of layers including an innermost layer most proximate a wearer when worn and an outermost layer most distal the wearer when worn, wherein said protective garment configurable in a closed position wherein said front portions are generally fully connected together, and is configurable in an open position wherein said front portions are not connected together; and a skirt comprising a piece of material having an outer edge extending through the innermost layer and directly coupled to a middle layer positioned within the torso portion between the innermost layer and the outermost layer such that the skirt is positioned in said torso cavity and having an inner edge comprising a sealing member that automatically generally conforms to the wearer when said protective garment is worn by the wearer and is moved to said closed position without requiring any further action by the wearer.

19. The protective garment of claim 18, wherein the sealing member includes an elastic material extending along the length of the skirt.

20. The protective garment of claim 18, wherein the outer edge of the piece of material is coupled within the torso portion to a moisture barrier layer.

21. The protective garment of claim 20, wherein a thermal liner layer is included between the moisture barrier layer and the innermost layer, but only in the portion of the torsion portion positioned above the skirt.

22. The protective garment of claim 20, wherein the torso portion includes, as included in its plurality of layers, an outer shell most distal to the wearer and a first thermal liner positioned between the outer shell and the moisture barrier layer; wherein a second thermal liner is included between the moisture barrier layer and the innermost layer, but only in the portion of the torsion portion positioned above the skirt and, below the skirt, the first thermal liner includes a supplemental thermal liner attached to or integral with the first thermal liner.

23. The protective garment of claim 18, further comprising a first sealing material positioned above the skirt and overlaying both a portion of the piece of material and a portion of innermost layer that are most proximate the position where the outer edge of the piece of material extends through the innermost layer, and a second sealing material positioned below the skirt and overlaying both a portion of the piece of material and a portion of innermost layer that are most proximate the position where the outer edge of the piece of material extends through the innermost layer.

24. The protective garment of claim 23, wherein the sealing material extends onto the innermost layer far enough to cover any permanent or removable fasteners coupling the skirt within the torso portion such that a continuous moisture barrier or harmful material barrier is maintained within the protective garment.

25. The protective garment of claim 23, wherein the sealing material is an adhesive tape having a moisture barrier material as the tape backing.

26. A coat comprising:

a torso portion defining a torso cavity and including pair of edges that are releasably connectable together; and a skirt positioned in said torso cavity and configured to sealingly engage a wearer when said pair of edges are releasably connected together, said skirt extending from one of said edges and continuously to the other edge, said skirt having an inner edge formed by or coupled to an elastic material;

wherein the torso portion includes a moisture barrier, and the skirt transects the moisture barrier to define an upper moisture barrier portion positioned above the skirt and a lower barrier portion positioned below the skirt;

wherein a portion of the skirt distal to the inner edge is sandwiched between a portion of the upper moisture barrier that is proximate the skirt and a portion of the lower moisture barrier that is proximate the skirt.

27. The coat of claim 26 wherein said inner edge is configured to generally conform to a wearer when said pair of edges are releasably coupled together.

28. The coat of claim 26 wherein the coat is configured such that said skirt automatically generally sealingly engages the wearer when said coat is worn by the wearer and said edges are releasably connected without requiring any further action by the wearer.

29. A method for protecting a wearer of a coat comprising:

accessing a coat having a torso portion defining a torso cavity, the coat further including a pair of edges separated by an opening, and a skirt positioned in the torso cavity, the skirt configured to sealingly engage a wearer when said pair of edges are releasably connected together, said skirt extending from one of said edges and continuously to the other edge, said skirt having an inner edge formed by or coupled to an elastic material; wherein the torso portion includes a moisture barrier, and the skirt transects the moisture barrier to define an upper moisture barrier portion positioned above the skirt and a lower barrier portion positioned below the skirt; and wherein a portion of the skirt distal to the inner edge is sandwiched between a portion of the upper moisture barrier that is proximate the skirt and a portion of the lower moisture barrier that is proximate the skirt;

donning said coat by passing at least part of the wearer's body through said opening; and closing said coat by releasably connecting said edges together such that after the closing step the skirt generally sealingly engages the wearer around substantially the entire perimeter of said wearer, without requiring any further action by the wearer, to block harmful vapors.

* * * * *